US007232344B1

(12) United States Patent
Gillespie et al.

(10) Patent No.: US 7,232,344 B1
(45) Date of Patent: Jun. 19, 2007

(54) HIGH SPEED, CARD EDGE CONNECTOR

(75) Inventors: Brian J. Gillespie, Harrisburg, PA (US); Gary Biddle, Carlisle, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/605,687

(22) Filed: Nov. 28, 2006

Related U.S. Application Data

(60) Provisional application No. 60/740,459, filed on Nov. 28, 2005.

(51) Int. Cl.
*H01R 24/00* (2006.01)

(52) U.S. Cl. ..... 439/634

(58) Field of Classification Search ..... 439/634, 439/637, 223, 220, 160
See application file for complete search history.

(56) References Cited

U.S. PATENT DOCUMENTS 3,047,831 A * 7/1962 Majewski ..... 439/748
4,087,151 A * 5/1978 Robert et al. ..... 439/188
4,184,735 A * 1/1980 Ammon et al. ..... 439/637
2001/0016978 A1* 8/2001 Hamatani et al. ..... 29/612

* cited by examiner

*Primary Examiner*—Phuong Dinh
(74) *Attorney, Agent, or Firm*—Wei Te Chung

(57) ABSTRACT

A connector assembly (100) includes an insulative housing (10) defining a central slot (14) with two rows of passageways (16) by two sides thereof and two rows of contacts (20) disposed in the corresponding passageways, respectively. An electronic card (9) is received in the central slot and has a number of circuit pads (91) on a bottom portion thereof to engage the corresponding contacts, respective. Each of the contacts defines a contact section (22) extending into the central slot, and such contact section is of a downward bellows type with an overlapped region. The inner arm of the overlapped region provides a contact apex contacting the corresponding circuit pad. A height of the overlapped region is similar to a lengthwise dimension of the corresponding circuit pad when the printed circuit board is fully inserted into the slot.

1 Claim, 5 Drawing Sheets

HIGH SPEED, CARD EDGE CONNECTOR

CROSS REFERENCE TO RELATED APPLICATION

This application claims priority under 35 U.S.C. §119(e) of U.S. Provisional Patent Application No. 60/740,459 filed Nov. 28, 2005.

BACKGROUND OF THE INVENTION

1. Field of the Invention

The present invention generally relates to card edge connectors, and particularly to high-speed card edge connectors.

2. Description of Related Art

In today's high speed electronic systems, it is desirable that all components of an interconnection path be optimized for signal transmission characteristics, otherwise the integrity of the system will be impaired or degraded. High-speed card edge connectors are popular type of electrical connector that require passing fast rise time signals without distorting or degrading that rise time. Such high-speed card edge connectors are generally employed in computer and telecommunication equipments.

A conventional card edge connector commonly has an elongated housing defining an elongated slot for receiving a mating edge of a daughter printed circuit board or a card. A plurality of terminals are spaced along one or both sides of the slot for engaging contact pads adjacent the mating edge of the daughter printed circuit board to thereby establish electrical interconnection between the daughter card and a mother backplane printed circuit board on which the card edge connector is mounted. Such card edge connectors typically utilize preload features in the contacts in order to achieve a suitable contact force between the contacts and the inserted card.

U.S. Pat. Nos. 5,062,292 and 5,051,099 both disclose typical card edge connectors. Signal contact members of those card edge connectors are loaded from a mounting face of the housing and are inserted so that free tips thereof rest behind a plastic wall that exists between the card and the tips. Outwardly extending flanges of an intermediate portion of each signal contact member engage a corresponding flange receiving surface within the housing to lock the signal contact members within the housing. Noticeably, such a preloaded contact tip requires a long portion of the contact to extend above the contact-card interface. This length is required not only for providing a preload feature but also for allowing a sufficient lead-in portion on the contact. This tip design adds significant capacitance because the tip consists of a long extension that does not lie within the current path. This capacitance is detrimental to signal integrity. In common industry language, this tip design can be described as having a large electrical stub. In addition, the surface pads on the plug-in card are usually enlarged to provide sufficient surface area for the mating of the contacts. The increased surface area at the mating location increases the residual capacitance on the plug-in card, therefore further degrading signal integrity.

U.S. Pat. No. 5,919,049 discloses another conventional card edge connector. Similarly, the connector has preloaded contacts secured in the housing. It can be readily seen that the contacts as disclosed in these prior arts have tips pointing towards the inserted card. Clearly, it adds the risk of the card mechanically stubbing on the sheared tips of the contacts. Moreover, it is not easy to reduce the connector height for such a tip design.

U.S. Pat. No. 6,926,565 discloses another type of high speed card edge connector. The '565 patent suggests a modified geometry of the retention mechanism that holds the contact into the housing. In prior art for lower speed signals, the retention mechanism consists of a solid tab. The solid tab adds a discrete capacitance element between adjacent signal lines. Discrete capacitance elements within a connector's construction will degrade signal transmission. The '565 patent invention makes the solid tab a U shape geometry, forcing the current to flow around the outside perimeter defined by the retention mechanism. This geometry reduces capacitance and adds inductance. This balancing of capacitance and inductance provides better signal transmission. However, the '565 patent simply removes capacitance from a retention mechanism of the contact.

Hence, an improved high-speed card edge connector is highly desired.

BRIEF SUMMARY OF THE INVENTION

An object of the present invention is to provide improved contacts for reducing the capacitance of a high speed card edge connector which is adapted for receiving a daughter card.

Another object of the present invention is to provide an electrical connector having improved contacts for eliminating risk of the mechanically stubbing when a daughter card is inserted into the connector.

In order to achieve the above-mentioned objects, a connector assembly in accordance with the present invention includes an insulative housing defining a central slot with two rows of passageways by two sides thereof and two rows of contacts disposed in the corresponding passageways, respectively. An electronic card is received in the central slot and has a number of circuit pads on a bottom portion thereof to engage the corresponding contacts, respective. Each of the contacts defines a contact section extending into the central slot, and such contact section is of a downward bellows type with an overlapped region. The inner arm of the overlapped region provides a contact apex contacting the corresponding circuit pad. A height of the overlapped region is similar to a lengthwise dimension of the corresponding circuit pad.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
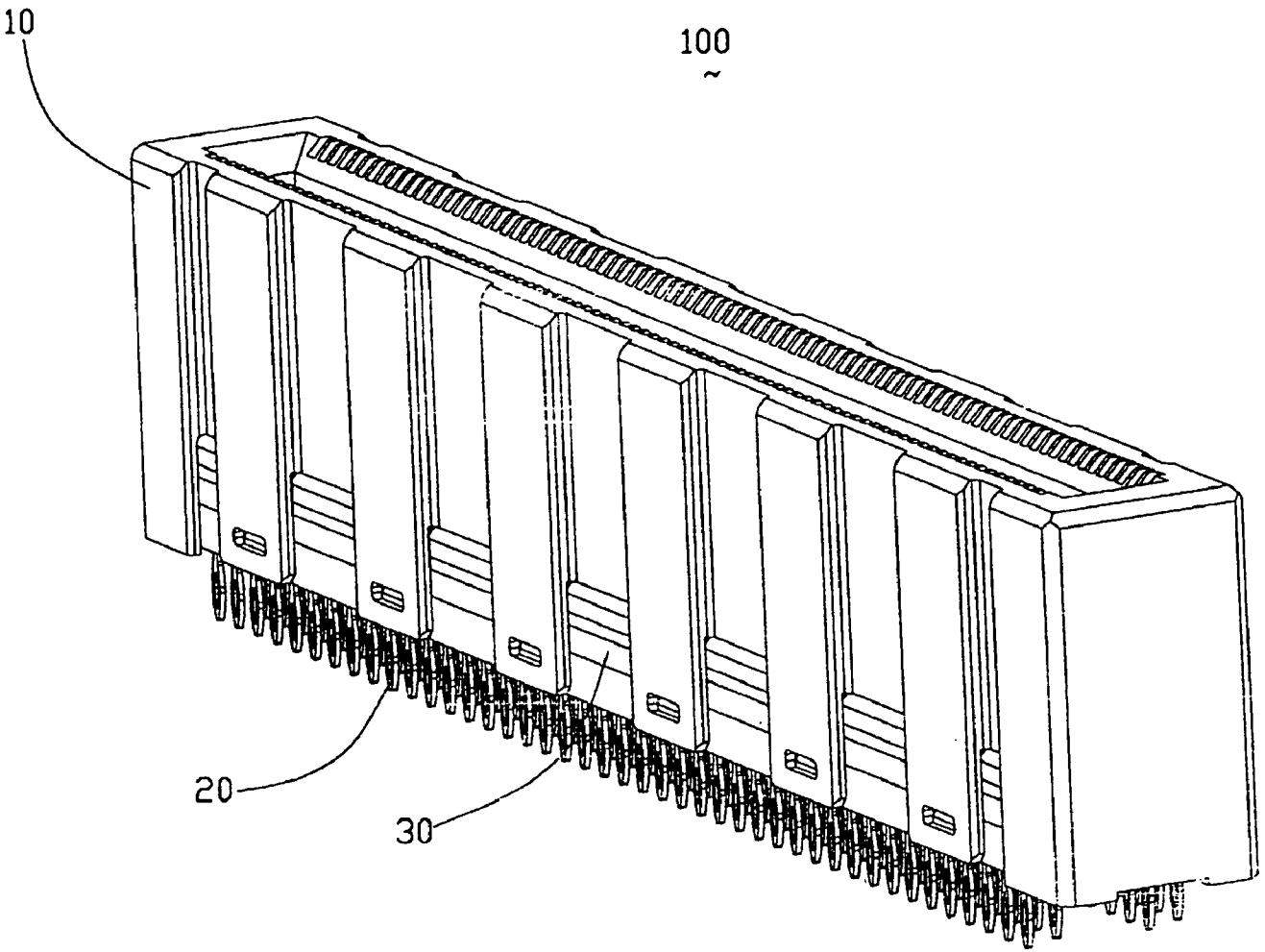
FIG. 1 is a perspective view of a card edge connector in accordance with the present invention.

Reference will now be made to the drawing figures to describe the present invention in detail.

Figure 2:
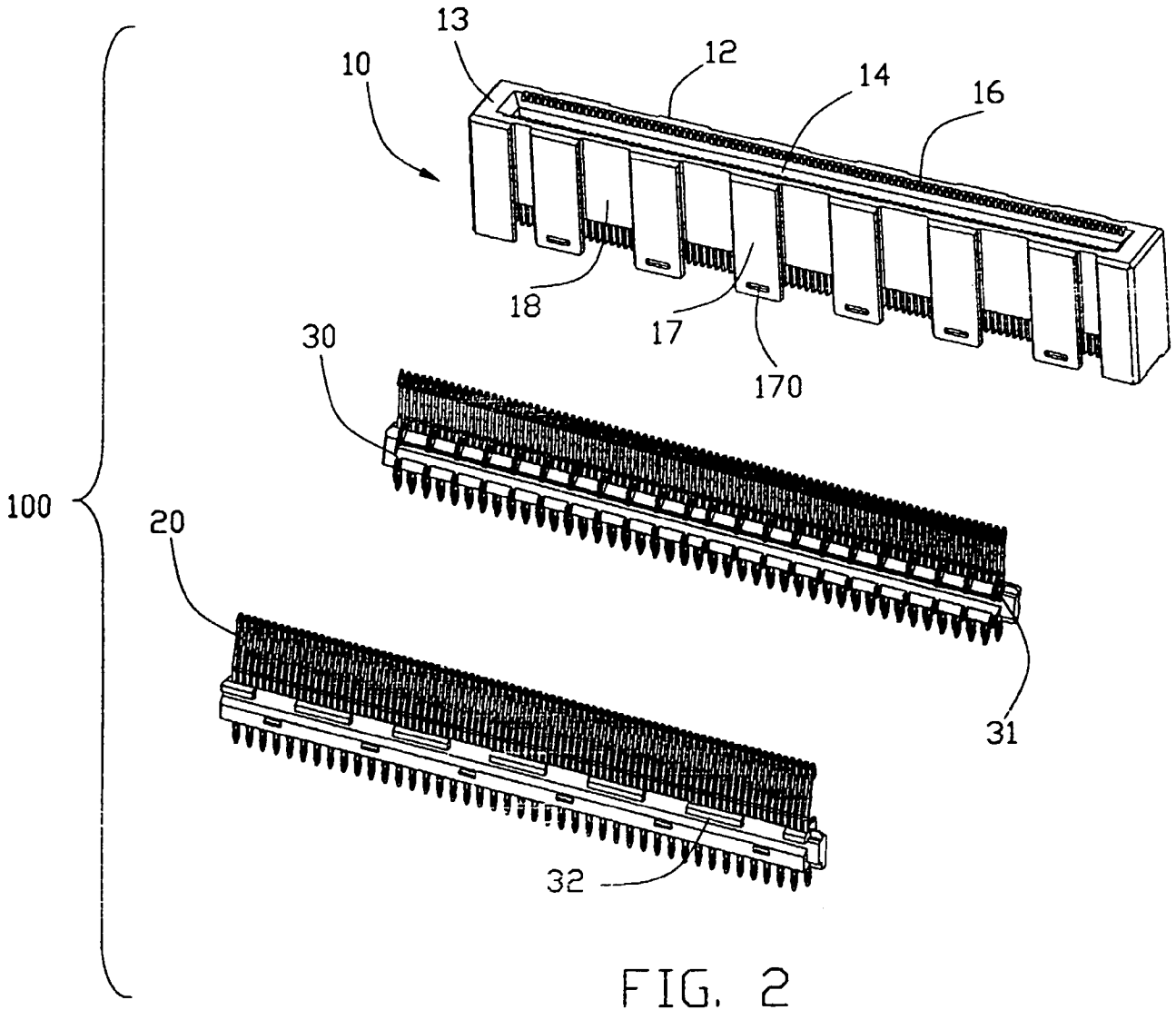
FIG. 2 is an exploded view of the connector shown in FIG. 1.

With reference to FIGS. 1–2, a card edge connector 100 in accordance with the present invention, which is adapted for mounting on a mother board (not shown) and receiving a daughter card 9 (FIG. 5), comprises a dielectric housing 10, a plurality of conductive contacts 20, and a pair of overmold members 30 assembled in the housing 10.

The dielectric housing 10 has a base wall 11, two side walls 12 extending upwardly from opposite longitudinal edges of the base wall 11, and two end walls 13 connecting distal edges of the two side walls 12. An elongated central slot 14 is surrounded by the walls 12, 13 above a top of the base wall 11. A pair of receiving openings 15 extend along a lengthwise direction beneath corresponding side walls 12 for receiving corresponding overmold members 30. Two rows of passageways 16 are disposed by two sides of the central slot 14 and extend through the side walls 12 for insertion of corresponding contacts 20. A plurality of spaced latches 17 are formed on outsides of the housing 10 with a latch hole 170 defined for locking the two overmold members 30 on the housing 10.

Figure 3:
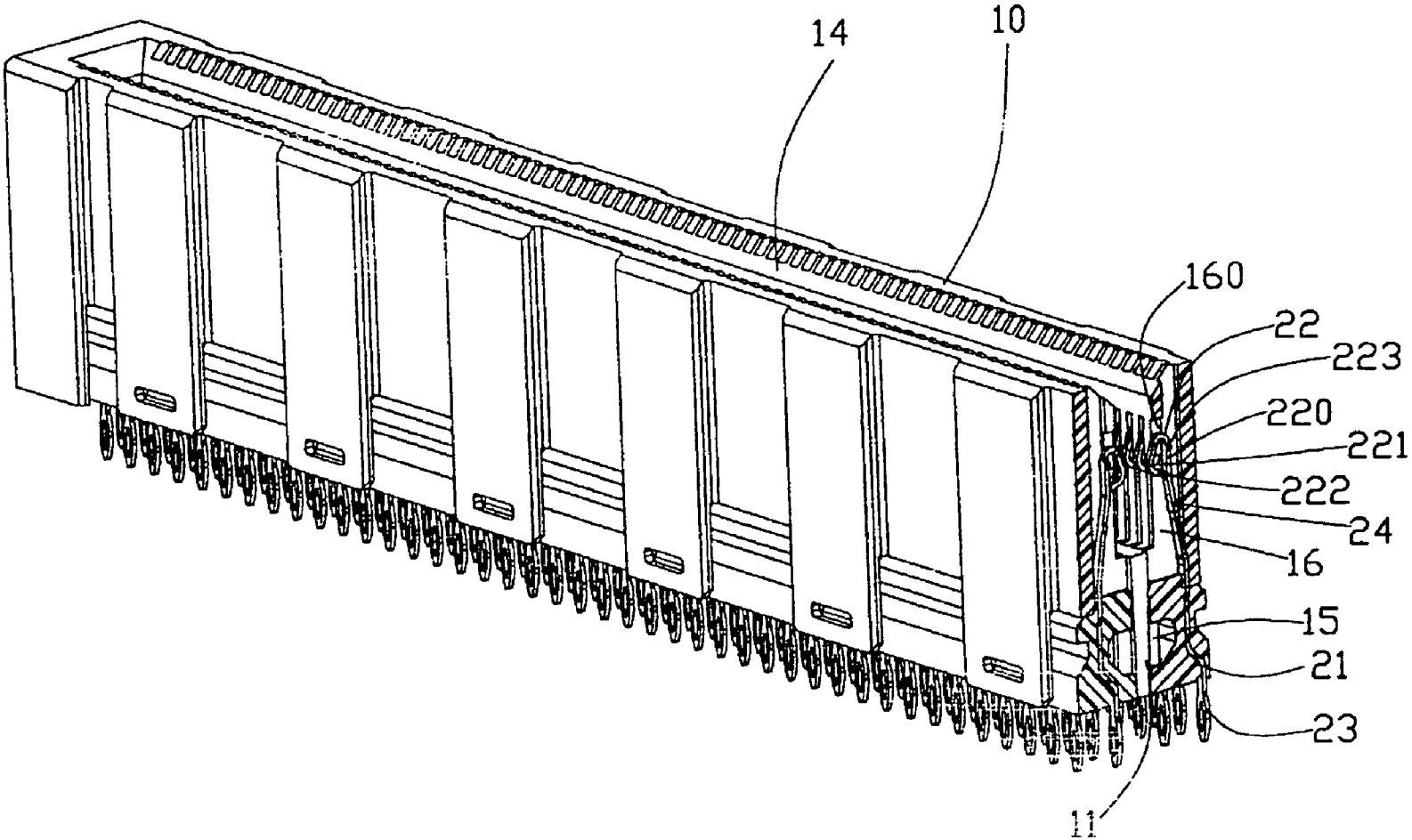
FIG. 3 is a perspective view, partly in section, of the connector shown in FIG. 1.
Figure 4:
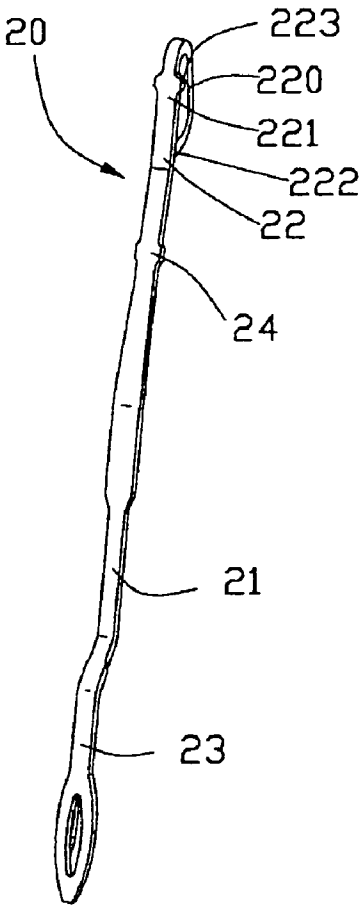
FIG. 4 is a perspective view of contacts.

In the preferred embodiment, the contacts 20 are inserted molded within the overmold members 30 which can share the same mold tooling (not shown) with a simple changeover key feature (not labeled) at the end of the mold. It should be noted here that one integral overmold 30 can be also applicable if desired. Attention is directed to FIGS. 3 and 4 wherein exemplary contacts 20 are illustrated in detail. Each contact 20 comprises an elongated body 21 insert molded in the overmold member 30, a contact section 22 formed on a top, and a tail 23 extending opposite to the contact section for electrically and mechanically connecting to the mother board. A neck portion 24 slantedly extends between the contact section 22 and the body 21 so that to provide a spring force to the contact 20 when the contact 20 is assembled into the housing 10. The contact section 22 includes a preloading stop portion 220 extending upwardly from the neck portion 24 and a letter "C"-like contacting portion 221 extending into the central slot 14 a predetermined distance. During the insertion of the daughter card 9, the neck portion 24 is deflected to the extent that the card can be substantially received in the central slot 14. As the neck portion 24 deflects, the "C"-like contacting portion 221 may compress some and move toward the preloading stop portion 220. However, the neck portion 24 is designed to provide the majority of the required deflection. If desired, the contact tip 222 may be designed to compress against the preloading stop portion 220 prior to the onset of permanent deformation of the "C"-like portion 221. In this way, the "C"-like portion will be supported by the preloading stop portion 220 and permanent deformation of the "C"-like portion will be prevented in the event that the contact experiences excessive forces or deflection. This will be referred to as a tip compression safety feature. A contact tip 222 is formed at a free end of the contact 20 and projects towards the preloading portion 220 away from the daughter card 9 when the card is inserted into the central slot 14. As can be readily seen in FIGS. 3 and 4, each passageway 16 has a pair of protrusions 160 formed on a top portion thereof and protruding inwardly so that a width of the top portion of the passageway 16 is narrower than the width of the rest portion. The preloading stop portion 220 of each contact 20 has projections 223 protruded on opposite edges thereof. The projections 223 are stopped by the protrusions 160 and abut thereagainst when the contact 20 is assembled to the passageway 60 so that a preloaded feature of the contact section 22 is achieved under the spring tension of the slantedly extended neck portion 24. Compared with some conventional card edge connector contacts, the contact of the present invention eliminates any risk of the daughter card 9 mechanically stubbing on the sheared tip of the contact. The contact tip 222 is pointing away from the daughter card 9 as the card 9 is inserted into the connector 100, while, in the prior arts, the tip is pointing towards the insertion of the card. Moreover, the "C"-like contacting portion 221 provides a lead-in feature as well known to the art.

In other words, the contact section 22 of the contact 20 is of downward bellows type with an overlapped region. An inner arm of the overlapped region provides a contact apex contacting the corresponding circuit pad. A height of the overlapped region is similar to a lengthwise dimension of the corresponding circuit pad.

Figure 5:
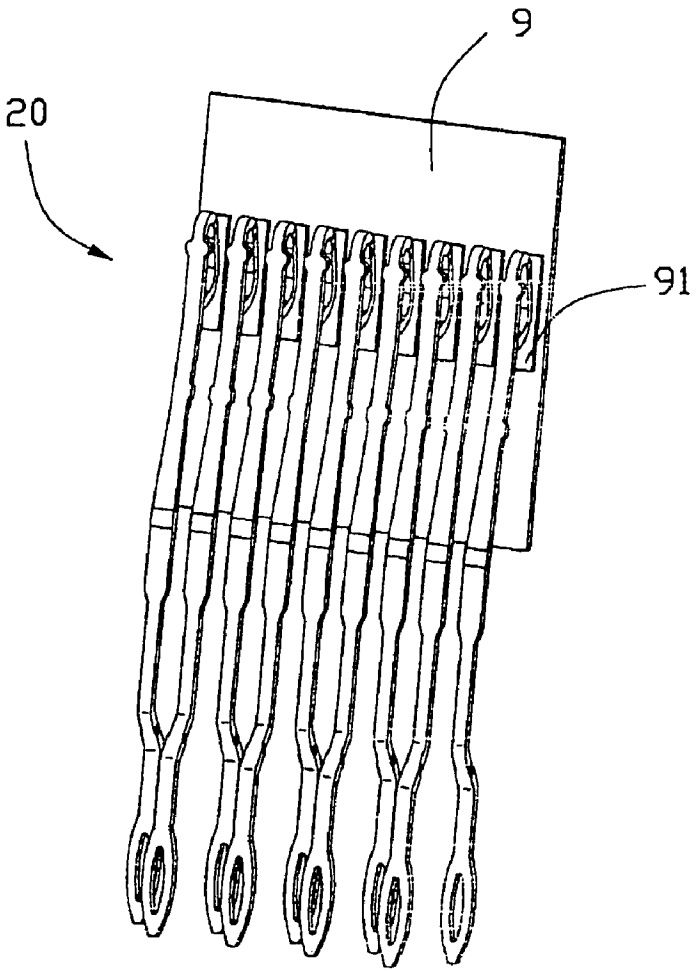
FIG. 5 is a perspective view of the contacts mounted on a printed circuit board.

Turn to FIG. 5, it should be noted here that the present contact provides an additional inductance component in a series of longitudinal planes formed by each of the contact sections, which are perpendicular to contact pads 91 of the mated plug-in daughter card 9. When the contact of the present invention and the plug-in card are considered simultaneously, the contact inductance cancels out the plug-in card capacitance. Therefore, the detrimental effect of the card capacitance is minimized. Also, in the present contact design, the entire lead-in feature and preload feature exist within the electrical current path. Only a very small portion of the contact, such as a portion between a point (not labeled) contact with the contact pad 91 and the corresponding contact tip, extends beyond the electrical current path. Therefore, the contact exhibits reduced capacitance by virtue of the reduction in electrical "stub" length. Thus, the signal integrity is improved. If the previously described tip compression safety feature is not required, then it's possible to shorten the electrical stub length to virtually nothing. The tip stub needs only to be designed long enough to form a sufficient contact interface radius.

The tail portion 23 of the contact 20 is configured as an eye of needle type press-fit tail 21 for insertion into holes of the mother board. However, other types of the tail portion are also applicable if desired. Note that the tail portions 23 of each row of contacts 20 are staggeredly arranged one by one. The contacts 20 with inner and outer arranged tails 23 have equal electrical length. In the preferred embodiment, for high-speed signal transmission requirement, differential pair of contacts are employed to transmit signals. Each differential pair are alternately arranged with ground contacts (not labeled).

Additionally, due to the "C"-like design of the contacting portion 221, the overall connector height can be reduced since the conventional contact design needs a relatively long portion to achieve the preload feature. It should be noted here that, although the preferred embodiment shows a preloaded contact configuration, the present invention can be also applied to a non-preloaded card edge connector.

Turn to FIG. 2 in conjunction with FIG. 3, the overmold member 30 are provided with a plurality of ribs 31 on inner side thereof. These ribs 31 ensure that the contacts 20 are touching the housing wall for proper force-deflection response. Opposite to the ribs 31, a plurality of spaced bars 32 are formed for engagement with the holes 170 of corresponding latches 17 to thereby lock the overmold members 30 on the housing 10. The two overmold members 30 have different keying features to prevent an improper assembly.

Figure 6:
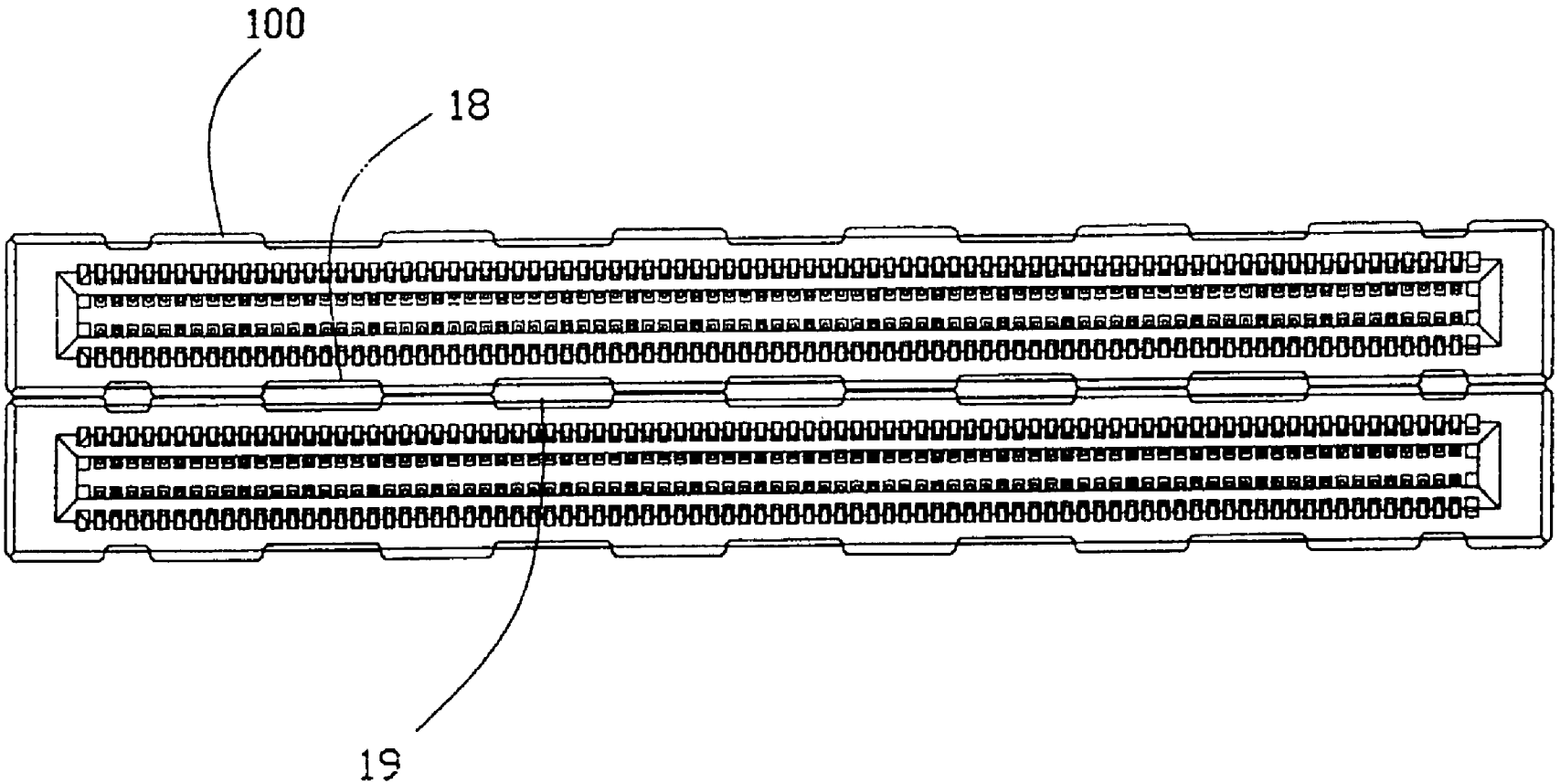
FIG. 6 is a top plan view of two side-by-side arranged connectors of the present invention.

Referring to FIG. 6, a pair of connectors 100 of the present invention are arranged side-by-side on a mother board (not shown). It can be readily seen that notches 18 defined between adjacent two latches 17 of each connector 100 cooperates with the notches 18 on the other connector and together define an opening 19 therebetween. These openings 19 allow for the extraction tooling (not shown) to reach between the connectors. The tooling will grab the overmold members 30 during the exaction process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a dielectric housing defining a pair of side walls, an upper central slot, and a pair of lower receiving openings, each side wall having a row of passageways; and a pair of overmold members and associated overmolded contact rows respectively disposed in the pair of receiving openings, each contact comprising an upper contact section and a tail, the contact section including a stop portion preloaded against the side wall and a continuing downwardly pointed contacting portion exposed through a corresponding passageway to the central slot, wherein: the dielectric housing comprises a central base wall separating the pair of receiving openings; and each overmold member is disposed between the base and one of the pair of side wall, wherein the overmold comprises a rib beating against the central base, wherein each passageway has on a top portion thereof a pair of protrusions; and the stop portion of the contact abuts against the protrusions, wherein the contact produces an inductance component in a series of longitudinal planes formed by each of the contact, sections when an electrical current flows through the contacts, wherein the side wall of the dielectric housing comprises outside alternating latches and notches.

* * * * *